US006000314A

United States Patent [19]

Masuda et al.

[11] Patent Number: 6,000,314

[45] Date of Patent: Dec. 14, 1999

[54] CYLINDER WITH SPEED CONTROL MECHANISM

[75] Inventors: Mitsuo Masuda; Hiroyuki Shimono, both of Yawara-mura, Japan

[73] Assignee: SMC Corporation, Japan

[21] Appl. No.: 09/149,811

[22] Filed: Sep. 8, 1998

[30] Foreign Application Priority Data

Sep. 25, 1997 [JP] Japan ..... 9-276606

[51] Int. Cl.[6] ..... F15B 15/022

[52] U.S. Cl. ..... 91/396; 91/406

[58] Field of Search ..... 91/396, 404, 405, 91/406

[56] References Cited

U.S. PATENT DOCUMENTS 2,719,510 10/1955 Elder ..... 91/396
5,307,729 5/1994 Hedlund ..... 91/406
5,429,035 7/1995 Kaneko et al. ..... 91/406

FOREIGN PATENT DOCUMENTS 7-158614 6/1995 Japan .

*Primary Examiner*—F. Daniel Lopez
*Attorney, Agent, or Firm*—Baker & Botts, L.L.P.

[57] ABSTRACT

A cylinder with a speed control mechanism wherein in a transfer stroke, a piston is smoothly accelerated or smoothly decelerated at an initiation or termination end of the stroke by controlling the speed of the piston, whereas in a return stroke, the speed of the piston is not controlled, thereby reducing the time required for the return stroke. A bypass passage bypassing longitudinal grooves for flow control provided on a cushion ring (74) is formed in a passage which provides communication between the outside and a main passage or a cylinder chamber (71, 72). A check valve (78A, 78B) is disposed in the bypass passage to allow a fluid to flow through the bypass passage only during the return stroke of the piston (6).

17 Claims, 6 Drawing Sheets

21
2
B
12
13
74A
78A
A
14
19
20
17A
18A
1
10
4
16
15
11
4A
93
3
5
7
22
18B
17B

SPEED-CONTROLLED OPERATION
W
TRANSFER STROKE

SPEED
TIME
REDUCTION

NORMAL OPERATION
RETURN STROKE

SPEED
TIME

CYLINDER WITH SPEED CONTROL MECHANISM

BACKGROUND OF THE INVENTION

The present invention relates to cylinders, for example, rodless cylinders, which are used to operate various machines. More particularly, the present invention relates to a cylinder with a speed control mechanism in which a piston is accelerated smoothly at an initiation end of a stroke thereof, or in which the piston is smoothly decelerated at a termination end of a stroke thereof.

Japanese Patent Application Unexamined Publication (KOKAI) No. 7-158614 discloses a rodless cylinder with a speed control mechanism. In the rodless cylinder, a piston is slidably fitted in a cylinder tube, and a head cover is secured to an end of the cylinder tube. A hollow cushion ring is disposed at the end of the cylinder tube such that the cushion ring can be inserted into a hollow portion of the piston. Sinusoidal grooves are formed on the outer surface of the cushion ring. The sinusoidal grooves are formed such that the depth thereof changes sinusoidally with respect to the longitudinal direction of the cushion ring. The sinusoidal grooves are deepest at the cushion approach side of the cushion ring. The rodless cylinder is arranged such that all of the fluid flowing between the inside and outside of the cylinder tube flows through an internal passage in the hollow cushion ring. The conventional rodless cylinder has the function of smoothly accelerating the piston at an initiation end of a stroke thereof, or the function of smoothly decelerating the piston at a termination end of a stroke thereof.

SUMMARY OF THE INVENTION

In the conventional rodless cylinder with a speed control mechanism, a cushioning action is exerted on the piston at the initiation and termination ends of not only a transfer (go) stroke of the piston but also a return stroke thereof, and the time required for the transfer stroke and the time required for the return stroke are the same. However, in the transfer stroke of the piston, as shown in FIGS. 6*a* and 6*b*, the piston must be smoothly accelerated and smoothly decelerated because an object W is transported by the transfer stroke, whereas, in the return stroke, as shown in FIGS. 6*c* and 6*d*, the piston needs to return in a short time regardless of the occurrence of an impact of certain magnitude because no object is transported by the return stroke. If the piston returns in a short time, the time required for the return stroke is reduced, and the production efficiency improves.

An object of the present invention is to provide a cylinder with a speed control mechanism wherein in a transfer stroke, a piston is smoothly accelerated or smoothly decelerated at an initiation or termination end of the stroke by controlling the speed of the piston, whereas in a return stroke, the speed of the piston is not controlled, thereby reducing the time required for the return stroke.

The present invention is applicable to a cylinder with a speed control mechanism of the type wherein a hollow cushion ring is disposed at an end of a cylinder tube such that the cushion ring can be inserted into a hollow portion of a piston. The cushion ring has a longitudinal groove for flow control formed on the outer surface thereof. A cylinder chamber is communicated with a port through a main passage including an internal passage in the cushion ring. According to a first aspect of the present invention, a bypass passage which bypasses the longitudinal groove for flow control of the speed control mechanism is formed in a passage which provides communication between the outside and the main passage or the cylinder chamber. A check valve is disposed in the bypass passage. The check valve allows a fluid to flow through the bypass passage only during a return stroke of the piston.

According to a second aspect of the present invention, the bypass passage in the arrangement according to the first aspect of the present invention is formed in a plate provided at the end of the cylinder tube. A U-packing is fitted in an annular groove formed on a cylindrical outer surface of a valve seat of the check valve. The direction of flow allowed by the check valve is changed by reversing the installation direction of the U-packing.

According to a third aspect of the present invention, a U-packing is fitted in an annular groove near an opening of the hollow portion of the piston in the arrangement according to the first aspect of the present invention. When the cushion ring is inserted into the hollow portion of the piston, a bypass passage is formed between the surface of the cushion ring and the inner surface of the hollow portion of the piston, and the U-packing functions as a check valve.

According to a fourth aspect of the present invention, the direction of flow allowed by the check valve in the arrangement according to the third aspect of the present invention is changed by reversing the installation direction of the U-packing.

According to a fifth aspect of the present invention, the hollow cushion ring is disposed at each end of the cylinder tube in the arrangement according to any one of the first to fourth aspects of the present invention, and cylinder chambers are communicated with respective ports through respective main passages and bypass passages.

According to a sixth aspect of the present invention, the longitudinal groove for flow control in the arrangement according to any one of the first to fifth aspects of the present invention is formed such that the depth thereof changes sinusoidally with respect to the longitudinal direction of the cushion ring. The longitudinal groove is deepest at the cushion approach side of the cushion ring.

In the cylinder with a speed control mechanism according to the present invention, a bypass passage which bypasses the longitudinal groove for flow control of the speed control mechanism is formed in a passage which provides communication between the outside and the main passage or the cylinder chamber, and a check valve is disposed in the bypass passage. The check valve allows a fluid to flow through the bypass passage only during the return stroke of the piston. Accordingly, in the transfer stroke, the speed of the piston is controlled at the initiation or termination end of the stroke to effect smooth acceleration or deceleration. In the return stroke, the speed of the piston is not controlled, and thus the time required for the return stroke is reduced.

According to the second and fourth aspects of the present invention, the direction of flow allowed by the check valve can be changed by reversing the installation direction of the U-packing. Thus, it is possible to readily change the direction of the return stroke, the time required for which is reduced.

According to the third aspect of the present invention, the time required for the return stroke is reduced simply by replacing the cushion packing in the hollow portion in the conventional cylinder by a U-packing. Thus, the present invention can be readily carried out.

DETAILED DESCRIPTION OF THE PREFERRED EMBODIMENTS

Figure 1:
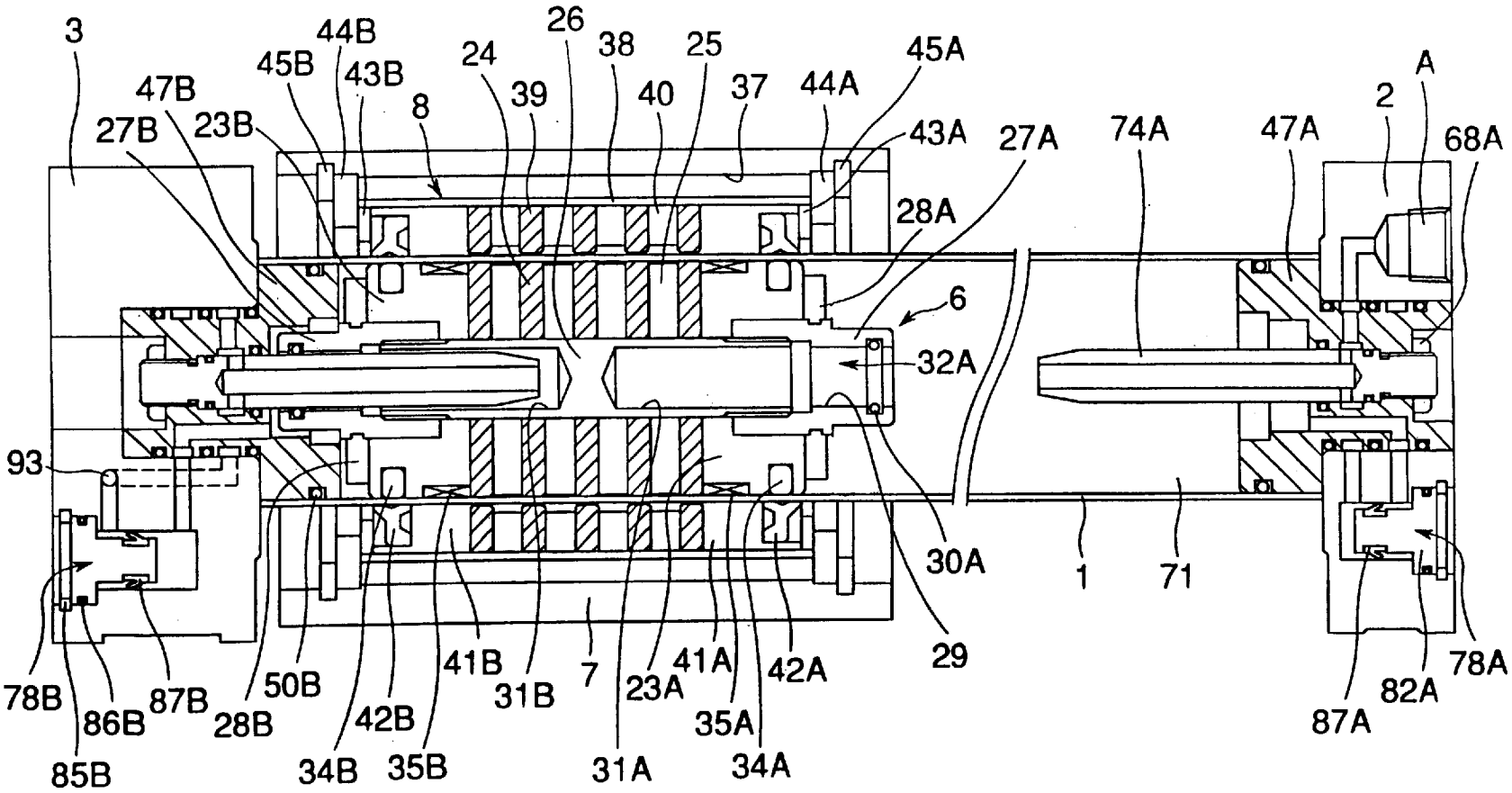
FIG. 1 is a sectional view showing the internal structures of a cylinder tube and other elements in a first embodiment of the present invention.

A first embodiment of the present invention in which a cylinder with a speed control mechanism according to the present invention is applied to a rodless cylinder will be described below with reference to FIGS. 1 to 3*b*.

A cylinder tube 1 is made of a non-magnetic material. A first plate (head cover) 2 and a second plate (head cover) 3 are secured to both ends, respectively, of the cylinder tube 1. A piston 6 is slidably fitted in the cylinder tube 1. A first guide shaft 4 and a second guide shaft 5 are disposed in parallel to the cylinder tube 1. Both ends of each of the first and second guides shafts 4 and 5 are secured to the first plate 2 and the second plate 3, respectively. A slide block 7 is guided by the first guide shaft 4 and the second guide shaft 5 and moved by an external moving member 8 which is disposed outside the cylinder tube 1.

Figures 2A, 2B:
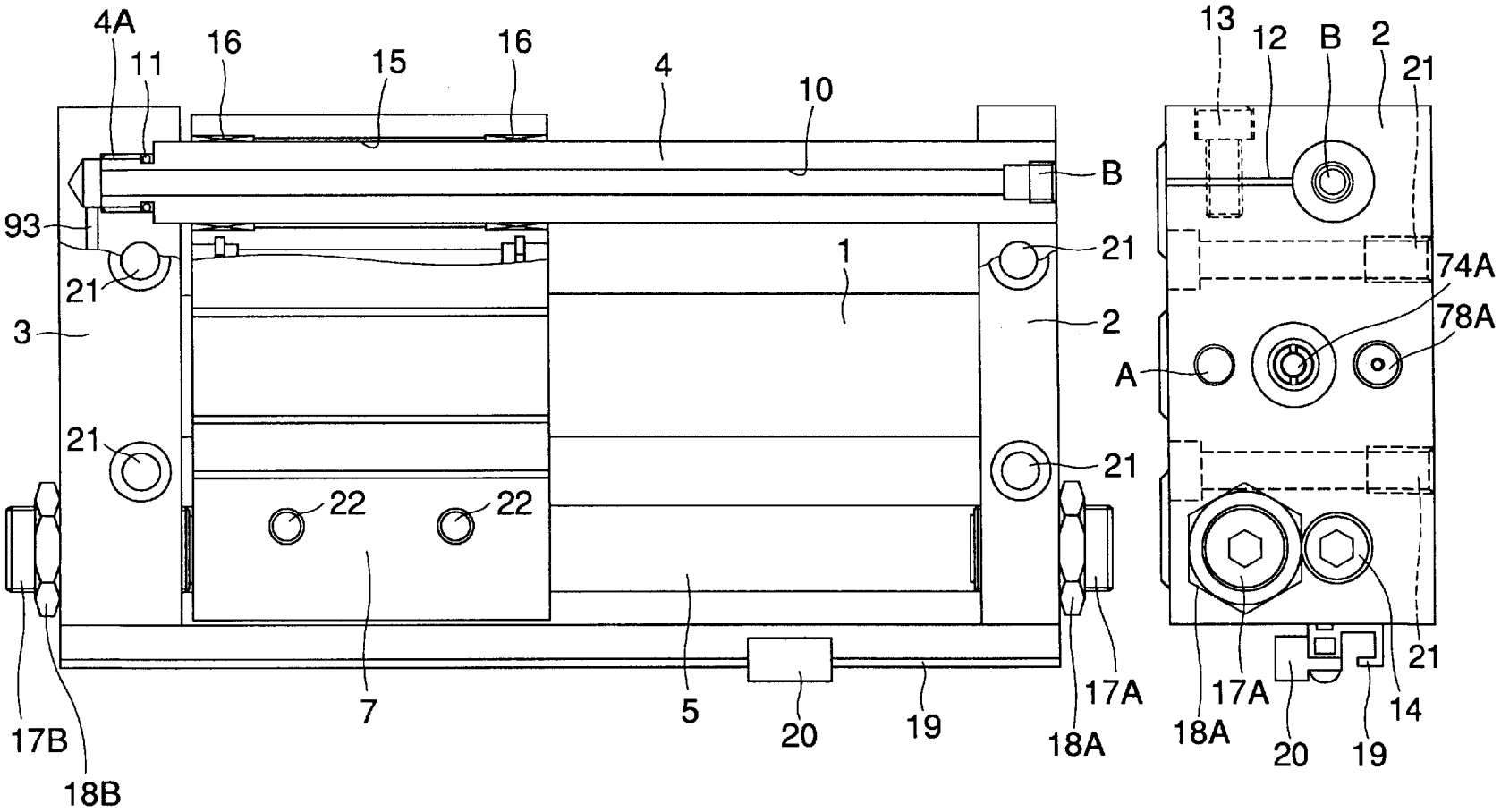
FIG. 2*a* is a partly-cutaway top plan view of the arrangement shown in FIG. 1.
FIG. 2*b* is a side view of the arrangement shown in FIG. 1, as viewed from the right-hand side thereof.

As shown in FIGS. 2*a* and 2*b*, the first guide shaft 4 has a passage 10 formed to extend therethrough. The left end of the first guide shaft 4 is provided with a small-diameter threaded portion 4A. The right end of the first guide shaft 4 is provided with a port B. The small-diameter threaded portion 4A of the first guide shaft 4 is engaged with an internally threaded portion of a stepped hole in the second plate 3. The area between the surface of the left end portion of the first guide shaft 4 and the inner surface of the stepped hole of the second plate 3 is hermetically sealed by a guide shaft gasket 11. The right end of the first guide shaft 4 is fitted into a through-hole in the first plate 2 and secured to the first plate 2 by narrowing a slit 12 in the first plate 2 with a bolt 13 (see FIG. 2*b*). The slit 12 extends from the upper surface of the first plate 2 to the through-hole. The second guide shaft 5, which is hollow, has internal threads (not shown) formed in both ends thereof. The two ends of the second guide shaft 5 are fitted into respective stepped holes (not shown) in the first and second plates 2 and 3. Hexagon socket head cap screws 14 are inserted into the respective stepped holes of the first and second plates 2 and 3 to engage with the respective internal threads on both ends of the second guide shaft 5. Thus, the two ends of the second guide shaft 5 are secured to the first plate 2 and the second plate 3, respectively.

The slide block 7 has a first slide-fitting bore 15 extending therethrough. Two bushes 16 are fitted to both end portions of the first slide-fitting bore 15. The first guide shaft 4 passes through the first slide-fitting bore 15 and the two bushes 16. The slide block 7 is further provided with a second slide-fitting bore (not shown) similar to the first slide-fitting bore 15. The second guide shaft 5 passes through the second slide-fitting bore. Thus, the slide block 7 is guided by the first guide shaft 4 and the second guide shaft 5. Adjust bolts 17A and 17B are screwed into respective internal threads of the first and second plates 2 and 3, and hexagon nuts 18A and 18B are screwed onto the adjust bolts 17A and 17B, respectively, thereby positioning the adjust bolts 17A and 17B. At each end of its stroke, the slide block 7 comes in contact at an end face thereof with the distal end of the adjust bolt 17A or 17B. Thus, the stroke of the slide block 7 can be adjusted by turning the adjust bolts 17A and 17B. It should be noted that reference numeral 19 denotes a rail for mounting a switch, and 20 an auto-switch. The position of the slide block 7 is detected by the auto-switch 20. Each of the first and second plates 2 and 3 are provided with securing bores 21. The slide block 7 is provided with mounting bores 22.

As shown in FIG. 1, piston end plates 23A and 23B are disposed on both end portions of the piston 6. The piston end plates 23A and 23B are annular and made of a non-magnetic material. A plurality of annular piston-side yokes 24 and a plurality of annular piston-side magnets 25 are alternately disposed between the piston end plate 23A and the piston end plate 23B. A shaft 26 made of a non-magnetic material extends through center bores of the piston end plates 23A and 23B and those of the piston-side yokes 24 and the piston-side magnets 25. The shaft 26 has externally threaded portions formed on the respective outer peripheries of both ends thereof. Approximately cylindrical cushion packing holders 27A and 27B have internally threaded portions formed on the inner side portions of their respective large-diameter portions. The internally threaded portions of the cushion packing holders 27A and 27B are engaged with the externally threaded portions of the shaft 26. It should be noted that the term "inner side" as used herein means "a side of the piston 6 (cylinder tube 1) which is closer to the center thereof as viewed in the longitudinal direction thereof (i.e. in the horizontal direction as viewed in FIG. 1). By this engagement, the large-diameter portions of the cushion packing holders 27A and 27B are fitted into respective large-diameter bores in the piston end plates 23A and 23B, and thus the piston-side yokes 24, the piston-side magnets 25 and the piston end plates 23A and 23B are fastened from the right and left sides by the cushion packing holders 27A and 27B.

Annular dampers 28A and 28B are fitted into respective annular grooves on the outer peripheries of the large-diameter portions of the cushion packing holders 27A and 27B. Cushion packings 30A and 30B are disposed in respective annular grooves near the openings of small-diameter bores 29 in the cushion packing holders 27A and 27B. The shaft 26 has blind holes 31A and 31B which open at both ends of the shaft 26. The blind holes 31A and 31B of the shaft 26 and the small-diameter bores 29 of the cushion packing holders 27A and 27B form a first hollow portion 32A and second hollow portion 32B of the piston 6. Hollow cushion rings 74A and 74B are secured to the first plate 2 and the second plate 3, respectively. The cushion rings 74A and 74B can be inserted into the first and second hollow portions 32A and 32B, respectively, of the piston 6. Piston packings 34A and 34B and wear rings 35A and 35B are fitted into respective annular grooves on the outer peripheral surfaces of the piston end plates 23A and 23B.

The external moving member 8 is slidably fitted on the outside of the cylinder tube 1. The external moving member 8 is fitted in a fitting bore 37 of the slide block 7. The external moving member 8 has a tube 38 made of a non-magnetic material. A plurality of annular moving member-side yokes 39 and a plurality of annular moving member-side magnets 40 are alternately disposed in the tube 38. Annular wear rings 41A and 41B are disposed on both sides of the alternately disposed yokes 39 and magnets 40. Scrapers 42A and 42B are fitted in respective annular grooves on the outer end portions of the wear rings 41A and 41B. Annular spacers 43A and 43B are disposed on the respective outer ends of the wear rings 41A and 41B. Annular moving member spacers 44A and 44B are brought into contact with both ends of the moving member tube 38 and the respective outer sides of the spacers 43A and 43B. The outer peripheral portions of the moving member spacers 44A and 44B are fitted into respective annular grooves formed in the inner peripheral surface of the fitting bore 37 of the slide block 7. Retaining rings 45A and 45B are brought into contact with the outer sides of the moving member spacers 44A and 44B, respectively. The outer peripheral portions of the retaining rings 45A and 45B are fitted into respective annular grooves with a large diameter formed in the inner peripheral surface of the fitting bore 37, thereby preventing the moving member spacers 44A and 44B from falling out. The moving member-side magnets 40 are in an attraction relationship to the piston-side magnets 25. Each moving member-side magnet 40 and each piston-side magnet 25 have the same thickness, and each moving member-side yoke 39 and each piston-side yoke 24 also have the same thickness. The external moving member 8 and the slide block 7, which are arranged as described above, move simultaneously with the movement of the piston 6 by the magnetic attraction force.

The internal structures of cushion holders 47A and 47B connected to both ends of the cylinder tube 1, together with the first and second plates 2 and 3, will be described below with reference to FIGS. 1 to 3*b*. The cushion holders 47A and 47B respectively have large-diameter portions 48A and 48B and small-diameter portions 49A and 49B on their outer surfaces. The large-diameter portions 48A and 48B are fitted to both end portions of the cylinder tube 1. The small-diameter portion 49A is fitted into a fitting bore 60 in the first plate 2. The small-diameter portion 49B is fitted into a large-diameter portion 61A of a stepped fitting bore 61 in the second plate 3. The two end surfaces of the cylinder tube 1 and the step portions of the cushion holders 47A and 47B are placed in contact with the inner side surfaces of the first and second plates 2 and 3. The contact portions are maintained in the illustrated positions by connecting the first and second guide shafts 4 and 5 to the first and second plates 2 and 3 as stated above. Cylinder tube gaskets 50A and 50B are fitted into respective annular grooves formed on the outer peripheries of the large-diameter portions 48A and 48B of the cushion holders 47A and 47B. The cylinder tube gasket 50A hermetically seals the area between the outer peripheral surface of the large-diameter portion 48A of the cushion holder 47A and the inner peripheral surface of one end portion of the cylinder tube 1. Similarly, the cylinder tube gasket 50B hermetically seals the area between the outer peripheral surface of the large-diameter portion 48B of the cushion holder 47B and the inner peripheral surface of the other end portion of the cylinder tube 1.

The outer peripheral surface of the small-diameter portion 49A of the cushion holder 47A is provided with, in order from the inner side, a first annular fitting groove, a first annular groove 57A, a second annular fitting groove, a second annular groove 58A, and a third annular fitting groove. Similarly, the outer peripheral surface of the small-diameter portion 49B of the cushion holder 47B is provided with, in order from the inner side, a first annular fitting groove, a first annular groove 57B, a second annular fitting groove, a second annular groove 58B, and a third annular fitting groove. The first annular fitting grooves, the second annular fitting grooves, and the third annular fitting grooves are fitted with first gaskets 63A and 63B, second gaskets 64A and 64B, and third gaskets 65A and 65B, respectively. The area between the fitting bore 60 of the first plate 2 and the outer periphery of the small-diameter portion 49A of the cushion holder 47A is hermetically sealed with the first gasket 63A at the inner side of the first annular groove 57A and also hermetically sealed with the second gasket 64A at a position between the first and second annular grooves 57A and 58A and further hermetically sealed with the third gasket 65A at the outer side of the second annular groove 58A. Similarly, the area between the large-diameter portion 61A of the second plate 3 and the outer periphery of the small-diameter portion 49B of the cushion holder 47B is hermetically sealed with the first gasket 63B at the inner side of the first annular groove 57B and also hermetically sealed with the second gasket 64B at a position between the first and second annular grooves 57B and 58B and further hermetically sealed with the third gasket 65B at the outer side of the second annular groove 58B. The cushion holder 47A is provided with, in order from the inner side, a large-diameter bore 51A, an intermediate-diameter bore 52A, a small-diameter insertion bore 53A, an internally threaded portion 54A, and a tool insertion bore 55A. Similarly, the cushion holder 47B is provided with, in order from the inner side, a large-diameter bore 51B, an intermediate-diameter bore 52B, a small-diameter insertion bore 53B, an internally threaded portion 54B, and a tool insertion bore 55B. The inner peripheral surfaces of the insertion bores 53A and 53B of the cushion holders 47A and 47B are provided with, in order from the inner side, annular fitting grooves and third annular grooves 59A and 59B, respectively. The annular fitting grooves are fitted with fourth gaskets 66A and 66B, respectively.

Figure 3A:
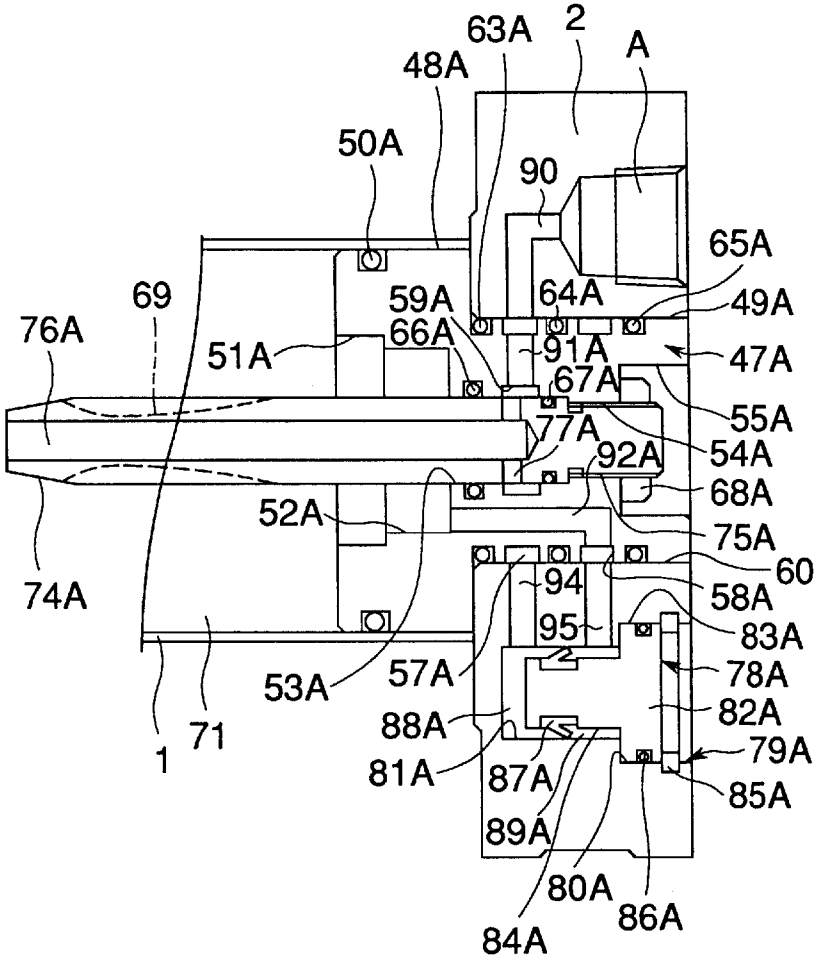
FIG. 3*a* is an enlarged view of the right end portion of the arrangement shown in FIG. 1.

Externally threaded portions 75A and 75B are formed on the proximal end portions of the cushion rings 74A and 74B at respective positions outside step portions formed on the proximal end portions of the cushion rings 74A and 74B. The distal end portions of the cushion rings 74A and 74B are tapered. As shown in FIG. 3*a*, the cushion ring 74A has a plurality of longitudinal grooves (sinusoidal grooves) 69 for flow control formed on the outer surface thereof (the same is the case with the cushion ring 74B). The flow control longitudinal grooves 69 have a rectangular or square sectional configuration. The proximal end portions of the cushion rings 74A and 74B are inserted into the insertion bores 53A and 53B of the cushion holders 47A and 47B, respectively, and the externally threaded portions 75A and 75B of the cushion rings 74A and 74B are engaged with the internally threaded portions 54A and 54B of the cushion holders 47A and 47B, respectively. Lock nuts 68A and 68B are screwed onto the externally threaded portions 75A and 75B of the cushion rings 74A and 74B, respectively, thereby securing the cushion rings 74A and 74B.

The cushion rings 74A and 74B have annular fitting grooves formed on their outer surfaces near the respective stepped portions. The annular fitting grooves are fitted with fifth gaskets 67A and 67B, respectively. The cushion rings 74A and 74B have internal passages which are formed from longitudinal bores 76A and 76B and lateral bores 77A and 77B, respectively. The front ends of the longitudinal bores 76A and 76B open at the distal ends of the cushion rings 74A and 74B. The rear ends of the longitudinal bores 76A and 76B are communicated with the third annular grooves 59A and 59B of the cushion holders 47A and 47B through the lateral bores 77A and 77B, respectively. The cushion holders 47A and 47B are provided with radially extending passages 91A and 91B, respectively. The passages 91A and 91B provide communication between the third annular grooves 59A and 59B and the first annular grooves 57A and 57B, respectively. The cushion holders 47A and 47B are further provided with passages 92A and 92B, respectively, which have an L-shaped sectional configuration. The passage 92A provides communication between a first cylinder chamber 71 (i.e. a chamber formed between the piston 6 and the cushion ring 74A) and the second annular groove 58A. The passage 92B provides communication between a second cylinder chamber 72 (i.e. a chamber formed between the piston 6 and the cushion ring 74B) and the second annular groove 58B.

In the first plate 2, a port A is formed above the fitting bore 60, and a stepped valve fitting bore 79A is formed below the fitting bore 60. In the second plate 3, a stepped valve fitting bore 79B is formed below the fitting bore 61. The port A and the first annular groove 57A are communicated through a passage 90 formed in the first plate 2. The first annular groove 57B and the passage 10 in the first guide shaft 4 are communicated through passages 98 and 93 formed in the second plate 3. The stepped valve fitting bores 79A and 79B are fitted with stepped valve seats 82A and 82B, respectively. The step portions of the valve seats 82A and 82B are brought into contact with the step portions of the valve fitting bores 79A and 79B, respectively. Retaining rings 85A and 85B are fitted in respective annular grooves formed in the inner peripheral surfaces of large-diameter bores 80A and 80B of the valve fitting bores 79A and 79B. The retaining rinds 85A and 85B prevent the valve seats 82A and 82B from falling out. O-rings 86A and 86B are fitted in respective annular fitting grooves formed on large-diameter portions 83A and 83B of the valve seats 82A and 82B. The O-ring 86A hermetically seals the area between the large-diameter portion 83A of the valve seat 82A and the large-diameter bore 80A of the valve fitting bore 79A. The O-ring 86B hermetically seals the area between the large-diameter portion 83B of the valve seat 82B and the large-diameter bore 80B of the valve fitting bore 79B.

Approximately cylindrical small-diameter portions 84A and 84B of the valve seats 82A and 82B project into respective small-diameter bores 81A and 81B of the valve fitting bores 79A and 79B with a predetermined spacing provided between the outer surface of each of the small-diameter portions 84A and 84B and the inner surface of each of the small-diameter bores 81A and 81B. Annular U-packings 87A and 87B are fitted into respective annular grooves formed on the distal end portions of the small-diameter portions 84A and 84B of the valve seats 82A and 82B. The U-packing 87A divides the space between the outer surface of the small-diameter portion 84A and the inner surface of the small-diameter bore 81A into a front chamber 88A and a rear chamber 89A. The U-packing 87B divides the space between the outer surface of the small-diameter portion 84B and the inner surface of the small-diameter bore 81B into a front chamber 88B and a rear chamber 89B. When placed in the illustrated positions, the U-packings 87A and 87B allow the flow of fluid in only one direction from the front chambers 88A and 88B to the rear chambers 89A and 89B while blocking the flow of fluid in the reverse direction. Thus, a first check valve 78A and a second check valve 78B are formed. The first plate 2 is provided with passages 94 and 95. The passage 94 provides communication between the front chamber 88A of the first check valve 78A and the first annular groove 57A. The passage 95 provides communication between the rear chamber 89A of the first check valve 78A and the second annular groove 58A. The second plate 3 is provided with passages 96 and 97. The passage 96 provides communication between the front chamber 88B of the second check valve 78B and the second annular groove 58B. The passage 97 provides communication between the rear chamber 89B of the second check valve 78B and the passages 98 and 93.

As shown in FIG. 3*a*, the first cylinder chamber 71 is communicated with the port A through a first main passage which is formed from the flow control longitudinal grooves 69 on the outer surface of the cushion ring 74A and the longitudinal bore 76A and the lateral bore 77A in the cushion ring 74A, together with the third annular groove 59A, the passage 91A, the first annular groove 57A and the passage 90. A first bypass passage bypasses the internal passage of the cushion ring 74A and provides communication between the first cylinder chamber 71 and the first annular groove 57A. The first bypass passage is formed from the passage 92A, the second annular groove 58A and the passages 95 and 94. The first check valve 78A is disposed between the passages 95 and 94 of the first bypass passage. The first check valve 78A operates to block the flow of fluid during the transfer stroke of the piston 6. In the illustrated position, the first check valve 78A allows the flow of fluid in only one direction from the port A to the first cylinder chamber 71. To reverse the direction of flow allowed by the first check valve 78A, the valve seat 82A of the first check valve 78A is removed from the valve fitting bore 79A, and the U-packing 87A is removed from the annular groove and turned through 180 degrees about an axis perpendicular to the axis thereof before being refitted into the annular groove, and then the valve seat 82A is refitted into the valve fitting bore 79A (i.e. the installation direction of the U-packing 87A is reversed). That is, after being inverted, the first check valve 78A allows the flow of fluid in only one direction from the first cylinder chamber 71 to the port A.

Figure 3B:
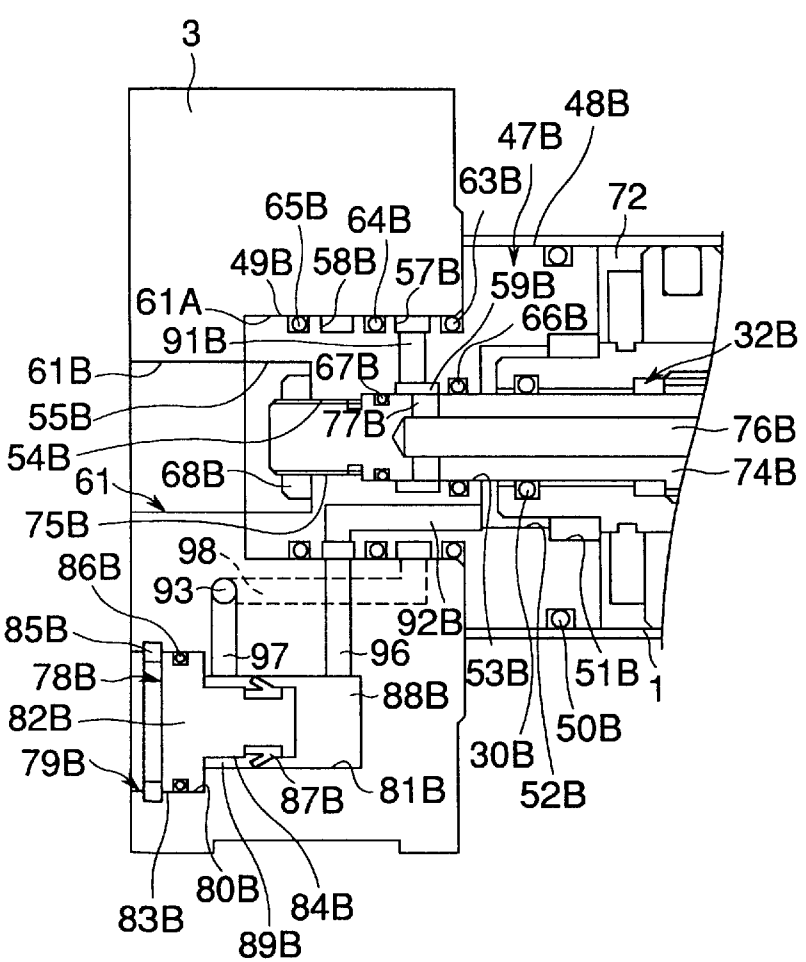
FIG. 3*b* is an enlarged view of the left end portion of the arrangement shown in FIG. 1.
Figure 4:
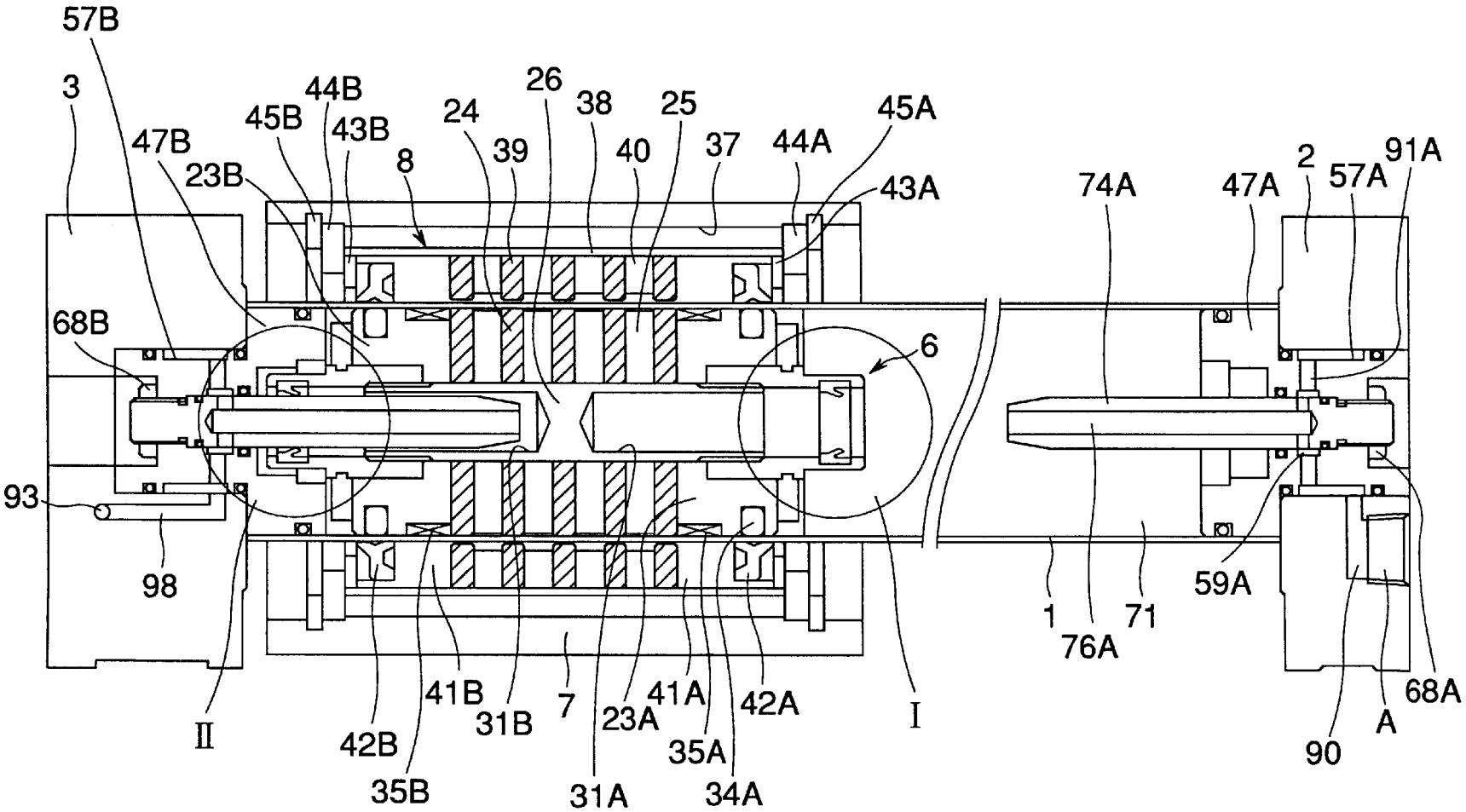
FIG. 4 is a sectional view showing the internal structures of a cylinder tube and other elements in a second embodiment of the present invention.
Figure 5A:
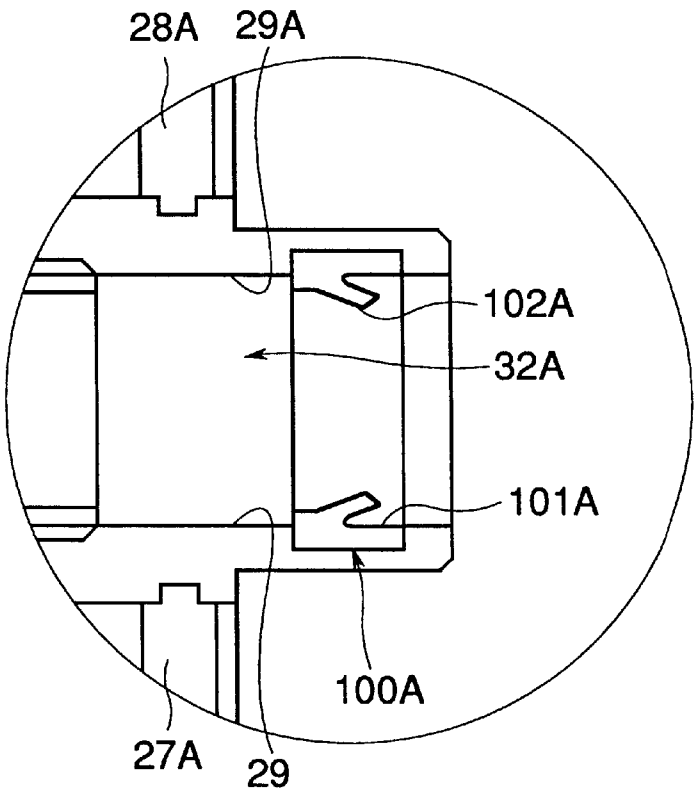
FIG. 5*a* is an enlarged view of part I in FIG. 4.
Figure 5B:
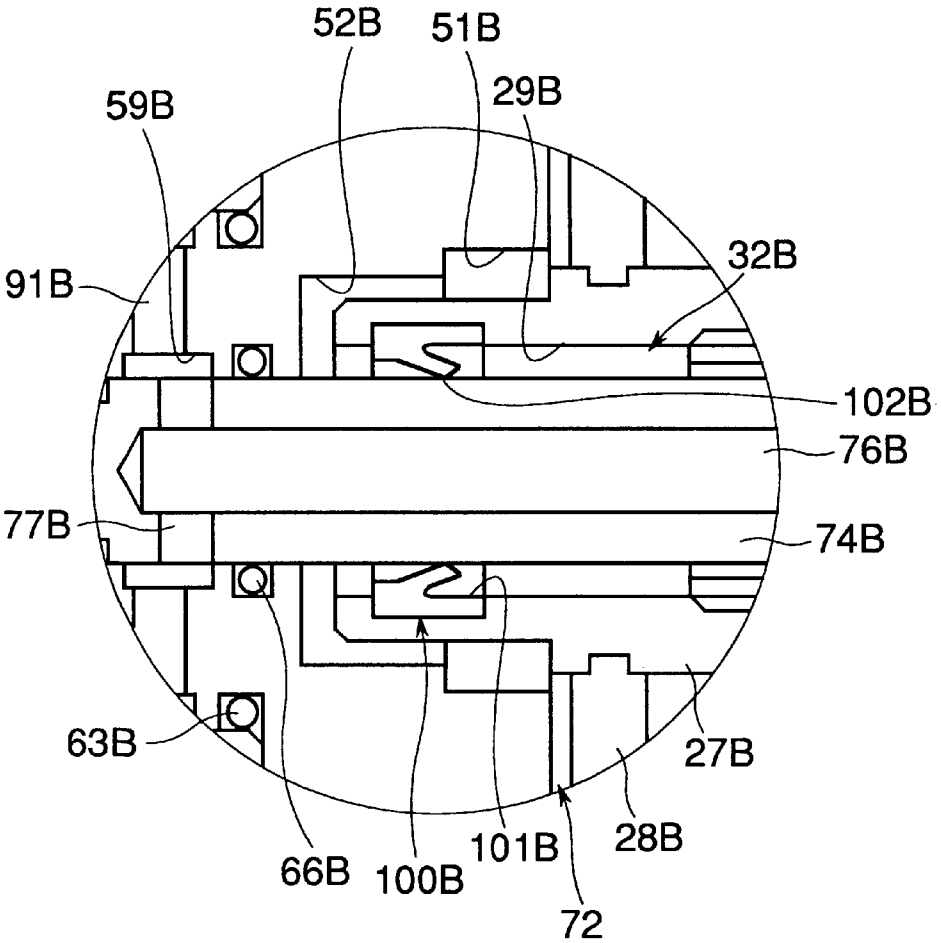
FIG. 5*b* is an enlarged view of part II in FIG. 4.

As shown in FIGS. 3*b* and 2*a*, the second cylinder chamber 72 is communicated with the port B through a second main passage which is formed from the flow control longitudinal grooves on the outer surface of the cushion ring 74B and the longitudinal bore 76B and the lateral bore 77B in the cushion ring 74B, together with the third annular groove 59B, the passage 91B, the first annular groove 57B, the passages 98 and 93, and the passage 10 in the first guide shaft 4. A second bypass passage bypasses the internal passage of the cushion ring 74B and provides communication between the second cylinder chamber 72 and the passage 93. The second bypass passage is formed from the passage 92B, the second annular groove 58B and the passages 96 and 97. The second check valve 78B is disposed between the passages 96 and 97 of the second bypass passage. The second check valve 78B allows the flow of fluid only during the return stroke of the piston 6. In the illustrated position, the second check valve 78B allows the flow of fluid in only one direction from the second cylinder chamber 72 to the port B. The direction of flow allowed by the second check valve 78B is reversed by reversing the installation direction of the U-packing 87B of the second check valve 78B as in the case of the first check valve 87A. That is, after being inverted, the second check valve 78B allows the flow of fluid in only one direction from the port B to the second cylinder chamber 72.

The operation of the first embodiment of the present invention will be described below. To perform a transfer stroke for moving rightward the piston 6 and the slide block 7 which are in the left end position as shown in FIGS. 1 to 3*b*, driving air is supplied from the port B and discharged from the port A. The driving air flows into the second cylinder chamber 72 through the second main passage. The flow rate of the driving air is controlled through the gap between the cushion packing 30B in the second hollow portion 32B (i.e. the blind hole 31B and the small-diameter bore 29 of the cushion packing holder 27B) of the second main passage and the flow control longitudinal grooves (sinusoidal grooves) on the outer periphery of the cushion ring 74B. At this time, the second check valve 78B in the second bypass passage does not allow the flow of fluid from the port B to the second cylinder chamber 72. Therefore, no fluid flows into the second cylinder chamber 72 through the second bypass passage. The air in the first cylinder chamber 71 is discharged through the first main passage and the port A. At this time, the first check valve 78A in the first bypass passage does not allow the flow of fluid from the first cylinder chamber 71 to the port A; therefore, there is no fluid discharged through the first bypass passage.

Figures 6A, 6B, 6C, 6D:
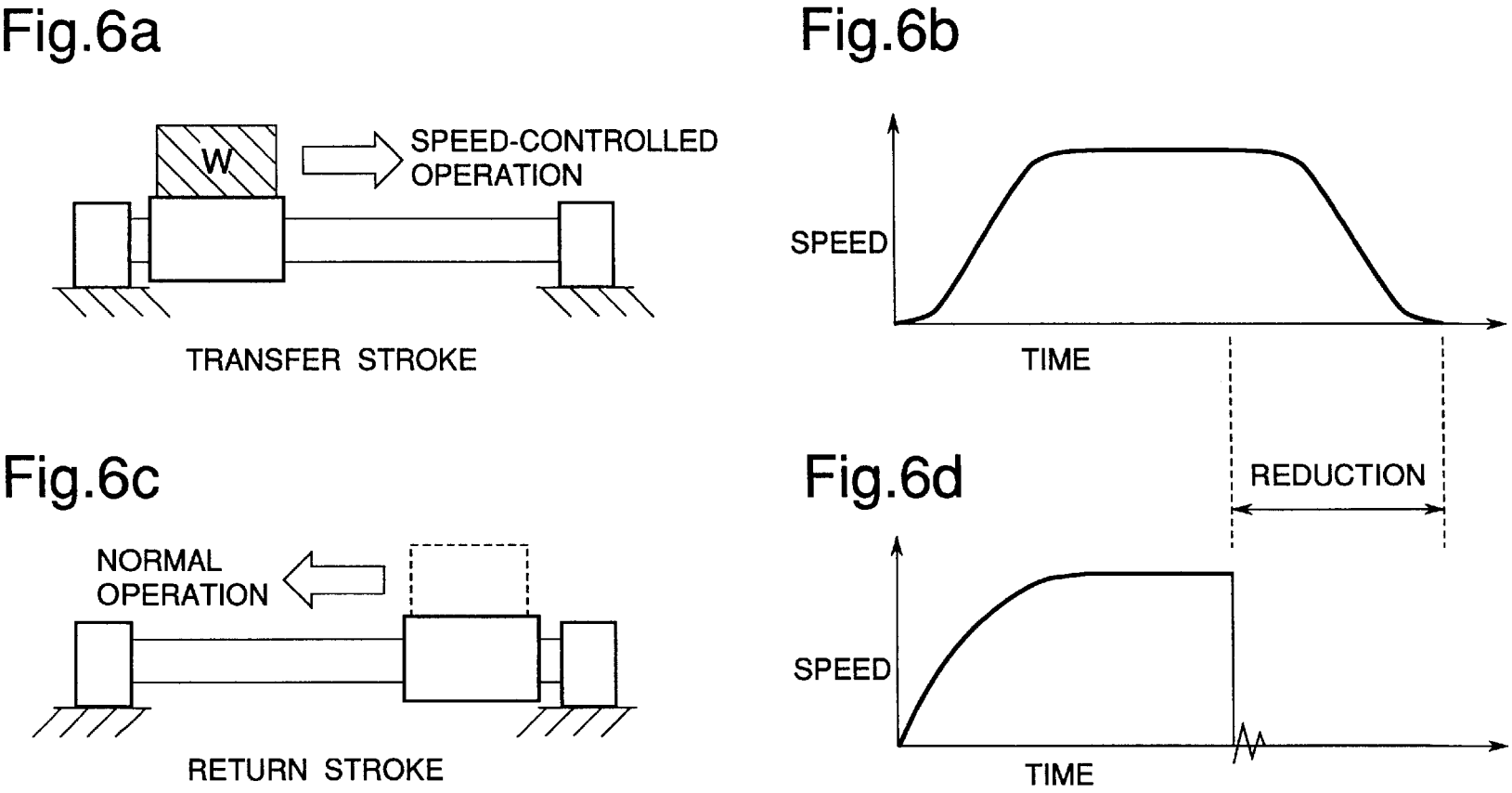
FIGS. 6*a* and 6*b* are diagrams showing a transfer stroke in the first and second embodiments of the present invention.
FIGS. 6*c* and 6*d* are diagrams showing a return stroke in the embodiments of the present invention.

When the pressure in the second cylinder chamber 72 becomes higher than the starting pressure for the piston 6, rightward movement of the piston 6 is started. As the piston 6 moves, the gap between the cushion packing 30B and the sinusoidal grooves on the outer periphery of the cushion ring 74B gradually widens (becomes deeper). The flow rate of driving air supplied to the second cylinder chamber 72 gradually increases, causing thrust to increase. Thus, the piston 6 is accelerated slowly. When the cushion packing 30B leaves the cushion ring 74B after the starting of the rightward movement of the piston 6, the piston 6 comes into a state of being driven at an approximately constant speed (see FIGS. 6*a* and 6*b*).

Thereafter, the cushion packing 30A of the piston 6 engages with the right cushion ring 74A, and the air in the first cylinder chamber 71 passes through the gap between the cushion packing 30A and the sinusoidal grooves on the outer periphery of the cushion ring 74A and further through the first hollow portion 32A (i.e. the blind hole 31A and the small-diameter bore 29 of the cushion packing holder 27A) and is discharged through the rest of the first main passage and the port A. At this time, the first check valve 78A in the first bypass passage does not allow the flow of fluid from the first cylinder chamber 71 to the port A; therefore, there is no fluid discharged through the first bypass passage. The sinusoidal grooves on the outer periphery of the cushion ring 74A are deep at the cushion approach side of the cushion ring 74A. Therefore, in the early stage of fitting of the cushion packing 30A onto the cushion ring 74A, a considerable amount of air is discharged, and hence the piston 6 is not rapidly braked. As the piston 6 travels, the gap between the cushion packing 30A and the sinusoidal grooves on the outer periphery of the cushion ring 74A gradually narrows (becomes shallower), and the flow rate of air discharged from the first cylinder chamber 71 is reduced. Accordingly, no rapid braking occurs, but the piston 6 is gradually decelerated and eventually reaches the stroke end (see FIGS. 6*a* and 6*b*).

To perform a return stroke for moving leftward the piston 6 and the slide block 7 which are in the right end position, driving air is supplied from the port A and discharged from the port B. At this time, the first check valve 78A in the first bypass passage allows the flow of fluid from the port A to the first cylinder chamber 71. Therefore, the fluid passing through the first bypass passage flows into the first cylinder chamber 71 without the flow rate thereof being controlled. The driving air further passes through the first main passage and further through the gap between the cushion packing 30A and the sinusoidal grooves on the outer periphery of the cushion ring 74A, which forms a part of the first main passage, and flows into the first cylinder chamber 71. Thus, thrust for moving the piston 6 is produced. At this time, the second check valve 78B in the second bypass passage allows the flow of fluid from the second cylinder chamber 72 to the port B. Therefore, the air in the second cylinder chamber 72 is discharged from the port B through the second bypass passage and the passages 93 and 10 and also discharged through the second main passage. The flow rate of discharged fluid is not controlled.

When the pressure in the first cylinder chamber 71 becomes higher than the starting pressure for the piston 6, the leftward movement of the piston 6 is started. Because the flow rate of fluid flowing into the first cylinder chamber 71 is not controlled, the flow rate of driving air supplied to the first cylinder chamber 71 increases rapidly, causing the thrust to increase. Accordingly, the piston 6 is accelerated rapidly. After a short time, the speed of the piston 6 becomes approximately constant. Thereafter, the second hollow portion 32B of the piston 6 engages with the cushion ring 74B. At this time, the air in the second cylinder chamber 72 is continuously discharged through the second bypass passage. Accordingly, the piston 6 continues moving without being decelerated. The slide block 7 and the piston 6 stop when the slide block 7 collides against the distal end of the adjust bolt 17B. As shown in FIGS. 6*a* to 6*d*, the time required for the return stroke is considerably reduced in comparison to the time required for the transfer stroke.

In the first embodiment, each bypass passage is formed so as to bypass the internal passage in the cushion ring, which forms a part of the main passage. However, the arrangement may be such that ports C and D are formed in the first plate 2, and the first cylinder chamber 71 and the second cylinder chamber 72 are communicated with the ports C and D, respectively, through respective bypass passages, and that the port A and the port C are communicated by a piping, and the port B and the port D are similarly communicated by a piping (this is a modification in which the first embodiment is changed for the worse). In each bypass passage, a check valve is disposed which allows the flow of fluid only during the return stroke of the piston.

A second embodiment of the present invention in which a cylinder with a speed control mechanism according to the present invention is applied to a rodless cylinder will be described below with reference to FIGS. 2*a* and 4 to 5*b*. In the second embodiment, members having the same arrangements as those in the first embodiment are denoted by the same reference characters as used in the first embodiment, and a description thereof will be given briefly.

The second embodiment has a first and second main passages which are the same as those in the first embodiment but has neither of first and second bypass passages as provided in the first embodiment.

In the first embodiment, the cushion packings 30A and 30B are disposed in the annular grooves near the openings of the small-diameter bores 29 in the cushion packing holders 27A and 27B. In contrast, in the second embodiment, U-packings 101A and 101B are disposed in respective annular grooves near the openings of the small-diameter bores 29 of the cushion packing holders 27A and 27B. When the cushion ring 74A is inserted into the first hollow portion 32A, a third bypass passage is formed between the surface of the cushion ring 74A and the inner surface of the first hollow portion 32A. At this time, an inner lip portion 102A of the U-packing 101A engages with the surface of the cushion ring 74A to function as a third check valve 100A. When the cushion ring 74B is inserted into the second hollow portion 32B, a fourth bypass passage is formed between the surface of the cushion ring 74B and the inner surface of the second hollow portion 32B. At this time, an inner lip portion 102B of the U-packing 101B engages with the surface of the cushion ring 74B to function as a fourth check valve 100B.

A control portion of the first main passage is formed between the inner lip portion 102A and the sinusoidal grooves of the cushion ring 74A. A control portion of the second main passage is formed between the inner lip portion 102B and the sinusoidal grooves of the cushion ring 74B. The third bypass passage bypasses the control portion of the first main passage. The fourth bypass passage bypasses the control portion of the second main passage. The third check valve 100A and the fourth check valve 100B allow the flow of fluid only during the return stroke of the piston 6 when the cushion rings 74A and 74B are engaged with the U-packings 101A and 101B, respectively. More specifically, when the U-packing 101A and the cushion ring 74A are engaged with each other, the third check valve 100A allows the flow of fluid from the first hollow portion 32A to the first cylinder chamber 71 but blocks the flow of fluid in the reverse direction. When the U-packing 101B and the cushion ring 74B are engaged with each other, the fourth check valve 100B allows the flow of fluid from the second cylinder chamber 72 to the second hollow portion 32B but blocks the flow of fluid in the reverse direction. If the U-packings 101A and 101B of the third and fourth check valves 100A and 100B are each removed from the annular groove and turned through 180 degrees about an axis perpendicular to the axis thereof before being refitted into the annular groove (i.e. the installation direction of each of the U-packings 101A and 101B is reversed), the direction of flow allowed by each of the third and fourth check valves 100A and 100B is reversed. The arrangement of the rest of the second embodiment is the same as in the first embodiment.

The operation of the second embodiment of the present invention will be described below. To perform a transfer stroke for moving rightward the piston 6 and the slide block 7 which are in the left end position as shown in FIGS. 2*a* and 4 to 5*b*, driving air is supplied from the port B and discharged from the port A. The driving air flows into the second cylinder chamber 72 through the second main passage. The flow rate of driving air flowing into the second cylinder chamber 72 is controlled through the gap between the U-packing 101B in the second hollow portion 32B of the second main passage and the sinusoidal grooves on the outer periphery of the cushion ring 74B. At this time, the fourth check valve 100B in the fourth bypass passage does not allow the flow of fluid from the port B to the second cylinder chamber 72. Therefore, no fluid flows into the second cylinder chamber 72 from the fourth bypass passage. The air in the first cylinder chamber 71 is discharged through the first main passage and the port A. Thus, the piston 6 starts and then comes into a state of being driven at an approximately constant speed as in the case of the first embodiment.

Thereafter,the U-packing 101A of the piston 6 engages with the right cushion ring 74A. The air in the first cylinder chamber 71 passes through the gap between the U-packing 101A and the sinusoidal grooves on the outer periphery of the cushion ring 74A and further through the first hollow portion 32A and is discharged through the rest of the first main passage and the port A. At this time, the third check valve 100A in the third bypass passage does not allow the flow of fluid from the first cylinder chamber 71 to the port A. Therefore, there is no fluid discharged through the third bypass passage. Thereafter, the piston 6 is gradually decelerated and eventually reaches the stroke end as in the case of the first embodiment.

To perform a return stroke for moving leftward the piston 6 and the slide block 7 which are in the right end position, driving air is supplied from the port A and discharged from the port B. At this time, the third check valve 100A in the third bypass passage, which is formed between the inner surface of the first hollow portion 32A and the surface of the cushion ring 74A, allows the flow of fluid from the port A to the first cylinder chamber 71. Therefore, the fluid passing through the third bypass passage flows into the first cylinder chamber 71 without the flow rate thereof being controlled. The driving air further passes through the gap between the inner lip portion 102A and the sinusoidal grooves on the outer periphery of the cushion ring 74A in the first main passage to flow into the first cylinder chamber 71.

Thus, thrust for moving the piston 6 is produced, and the piston 6 is rapidly accelerated as in the case of the first embodiment. After a short time, the speed of the piston 6 becomes approximately constant. Thereafter, the second hollow portion 32B of the piston 6 engages with the cushion ring 74B. At this time, the fourth check valve 100B in the fourth bypass passage, which is formed between the inner surface of the second hollow portion 32B and the surface of the cushion ring 74B, allows the flow of fluid from the second cylinder chamber 72 to the port B. Therefore, the air in the second cylinder chamber 72 is continuously discharged through the fourth bypass passage. Accordingly, the piston 6 continues moving without being decelerated. The slide block 7 and the piston 6 stop when the slide block 7 collides against the distal end of the adjust bolt 17B. The time required for the return stroke is considerably reduced in comparison to the time required for the transfer stroke as in the case of the first embodiment. Thus, the second embodiment provides the same advantageous effects as in the first embodiment by making a minimal modification to the conventional cylinder structure, that is, by replacing the cushion packings with the U-packings.

What we claim is:

1. In a cylinder having a piston speed control mechanism of the type wherein a hollow cushion ring is disposed at an end of a cylinder tube such that the cushion ring is received in a hollow portion of a piston during an end portion of a stroke of the piston, the cushion ring having a longitudinal groove for flow control formed on an outer surface thereof, and wherein a cylinder chamber of the cylinder tube is communicated with a port through a main passage that includes an internal passage in the cushion ring, the improvement comprising a bypass passage that bypasses the longitudinal groove of the speed control mechanism, the bypass passage providing communication between the cylinder chamber and the port, and a check valve disposed in the bypass passage, the check valve allowing a fluid to flow through the bypass passage only from the cylinder chamber to the port.

2. The improvement according to claim 1, wherein the bypass passage is formed in a plate provided at the end of the cylinder tube, and the check valve is a U-packing that is fitted in an annular groove formed on a cylindrical outer surface of a valve seat of the check valve.

3. The improvement according to claim 1, wherein the check valve is a U-packing that is received in an annular groove near an opening of the hollow portion of the piston, so that when the cushion ring is received in the hollow portion of the piston, the bypass passage includes a portion formed between the surface of the cushion ring and an inner surface of the hollow portion of the piston.

4. The improvement according to claim 1, wherein the longitudinal groove for flow control is formed such that a depth thereof changes sinusoidally with respect to a longitudinal direction of the cushion ring, the longitudinal groove being deepest at a cushion approach side of the cushion ring.

5. In a rodless cylinder having a cylinder tube and at each end of the cylinder tube a piston speed control mechanism of the type wherein a hollow cushion ring is disposed at the end of a cylinder tube such that the cushion ring is received in a hollow portion of a piston during an end portion of a stroke of the piston, the cushion ring having a longitudinal groove for flow control formed on an outer surface thereof, a cylinder chamber of the cylinder tube being communicated with a port through a main passage that includes an internal passage in the cushion ring, the improvement wherein one of the speed control mechanisms comprises a bypass passage that bypasses the longitudinal groove of the speed control mechanism, the bypass passage providing communication between the cylinder chamber and the port, and a check valve disposed in the bypass passage, the check valve allowing a fluid to flow through the bypass passage only from the cylinder chamber to the port.

6. The improvement according to claim 5, wherein the bypass passage is formed in a plate provided at the end of the cylinder tube, and the check valve is a U-packing that is fitted in an annular groove formed on a cylindrical outer surface of a valve seat of the check valve.

7. The improvement according to claim 5, wherein the check valve includes a U-packing that is received in an annular groove near an opening of the hollow portion of the piston, so that when the cushion ring is received in the hollow portion of the piston, a portion of the bypass passage is formed between the surface of the cushion ring and an inner surface of the hollow portion of the piston.

8. The improvement according to claim 5, wherein the longitudinal groove for flow control is formed such that a depth thereof changes sinusoidally with respect to a longitudinal direction of the cushion ring, the longitudinal groove being deepest at a cushion approach side of the cushion ring.

9. In a rodless cylinder having a cylinder tube, a first piston speed control mechanism at one end of the cylinder tube, a second piston speed control mechanism at the other end of the cylinder tube, each speed control mechanism being of the type wherein a hollow cushion ring is disposed at an end of a cylinder tube such that the cushion ring is received in a hollow portion of a piston during an end portion of a stoke of the piston, the cushion ring of each speed control mechanism having a longitudinal groove for flow control formed on an outer surface thereof, and wherein a first cylinder chamber of the cylinder tube is defined between the piston and the first speed control mechanism and a second cylinder chamber of the cylinder tube is defined between the piston and the second speed control mechanism, each cylinder chamber being communicated with a port through a main passage that includes an internal passage in the cushion ring, the improvement comprising a bypass passage in each speed control mechanism that bypasses the longitudinal groove of the speed control mechanism and provides communication between the port and the cylinder chamber, a check valve disposed in the bypass passage of one of the first and second speed control mechanisms that allows a fluid to flow through the bypass passage only from the cylinder chamber to the port of said one of the first and second speed control mechanisms, and a check valve disposed in the bypass passage of other of the first and second speed control mechanism that allows a fluid to flow through the bypass passage only from the port to the cylinder chamber of said other of the first and second speed control mechanisms.

10. The improvement according to claim 9, wherein each check valve is reversible so as to enable the direction of flow between the port and the cylinder chamber to be reversed and thereby permit the directions of a transfer stroke and a return stroke to be reversed.

11. The improvement according to claim 10, wherein the bypass passage of each speed control mechanism is formed in a plate provided at the end of the cylinder tube, and the check valve of each speed control mechanism is U-packing fitted in an annular groove formed on a cylindrical outer surface of a valve seat of the check valve.

12. The improvement according to claim 10, wherein the check valve is a U-packing that is received in an annular groove near an opening of the hollow portion of the piston, so that when the cushion ring is received in the hollow portion of the piston, the bypass passage includes a portion formed between the surface of the cushion ring and an inner surface of the hollow portion of the piston.

13. The improvement according to claim 9, wherein the bypass passage of each speed control mechanism is formed in a plate provided at the end of the cylinder tube, and the check valve of each speed control mechanism is U-packing fitted in an annular groove formed on a cylindrical outer surface of a valve seat of the check valve.

14. The improvement according to claim 13, wherein the direction of flow allowed by the check valve is changed by reversing an installation direction of the U-packing.

15. The improvement according to claim 9, wherein the check valve is a U-packing that is received in an annular groove near an opening of the hollow portion of the piston, so that when the cushion ring is received in the hollow portion of the piston, the bypass passage includes a portion formed between the surface of the cushion ring and an inner surface of the hollow portion of the piston.

16. The improvement according to claim 15, wherein the direction of flow allowed by the check valve is changed by reversing an installation direction of the U-packing.

17. The improvement according to claim 9, wherein the longitudinal groove for flow control in formed such that a depth thereof changes sinusoidally with respect to a longitudinal direction of the cushion ring, the longitudinal groove being deepest at a cushion approach side of the cushion ring.

* * * * *